US009346268B2

(12) United States Patent
Suzuki

(10) Patent No.: US 9,346,268 B2
(45) Date of Patent: May 24, 2016

(54) LIQUID EJECTION HEAD WITH NOZZLES EJECTING LIQUID FROM A PRESSURE GENERATION CHAMBER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Isao Suzuki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/681,288

(22) Filed: Apr. 8, 2015

(65) Prior Publication Data

US 2015/0290936 A1 Oct. 15, 2015

(30) Foreign Application Priority Data

Apr. 9, 2014 (JP) ..... 2014-080303

(51) Int. Cl.
*B41J 2/045* (2006.01)
*B41J 2/14* (2006.01)

(52) U.S. Cl.
CPC ..... *B41J 2/14209* (2013.01); *B41J 2/1433* (2013.01); *B41J 2/14201* (2013.01); *B41J 2002/14475* (2013.01)

(58) Field of Classification Search
CPC ..... B41J 2/04526; B41J 2/14201; B41J 2/14209; B41J 2/1433; B41J 2202/12; B41J 2002/14411; B41J 2002/14475
See application file for complete search history.

(56) References Cited

U.S. PATENT DOCUMENTS 8,091,983 B2 * 1/2012 Xie ..... B41J 2/03 347/47
2015/0145923 A1 5/2015 Suzuki

FOREIGN PATENT DOCUMENTS

JP 2009-233879 10/2009

* cited by examiner

*Primary Examiner* — Juanita D Jackson
(74) *Attorney, Agent, or Firm* — Amin, Turocy & Watson LLP; Gregory Turocy

(57) ABSTRACT

In accordance with an embodiment, a liquid ejection head comprises a pressure generation chamber in which liquid is filled; a plate configured to connect with the pressure generation chamber and include a plurality of liquid ejection sections of which the axes are directed to the center direction of an impact area of the liquid; and a driver configured to enable a pressure in the pressure generation chamber to fluctuate.

8 Claims, 5 Drawing Sheets

LIQUID EJECTION HEAD WITH NOZZLES EJECTING LIQUID FROM A PRESSURE GENERATION CHAMBER

CROSS-REFERENCE TO RELATED APPLICATION

This application is based upon and claims the benefit of priority from Japanese Patent Application No. 2014-080303, filed Apr. 9, 2014, the entire contents of which are incorporated herein by reference.

FIELD

Embodiments described herein relate generally to a liquid ejection head which ejects liquid from a nozzle.

BACKGROUND

There is a liquid jet head which consists of a plurality of nozzles in one pressure generation chamber to increase the ejection amount of liquid from the pressure generation chamber to enable the liquid to impact on an ejection target object efficiently. However, in a case of ejecting liquid from the plurality of nozzles arranged in one pressure generation chamber, there is a possibility that the impact dots of liquid disperse and expand, and as a result, a high concentration printing or high-speed printing cannot be obtained.

BRIEF DESCRIPTIONS OF THE DRAWING

DETAILED DESCRIPTION

In accordance with an embodiment, a liquid ejection head comprises a pressure generation chamber in which liquid is filled; a plate configured to connect with the pressure generation chamber and include a plurality of liquid ejection sections of which the axes are directed to the center direction of an impact area of the liquid; and a driver configured to enable a pressure in the pressure generation chamber to fluctuate.

Figure 1:
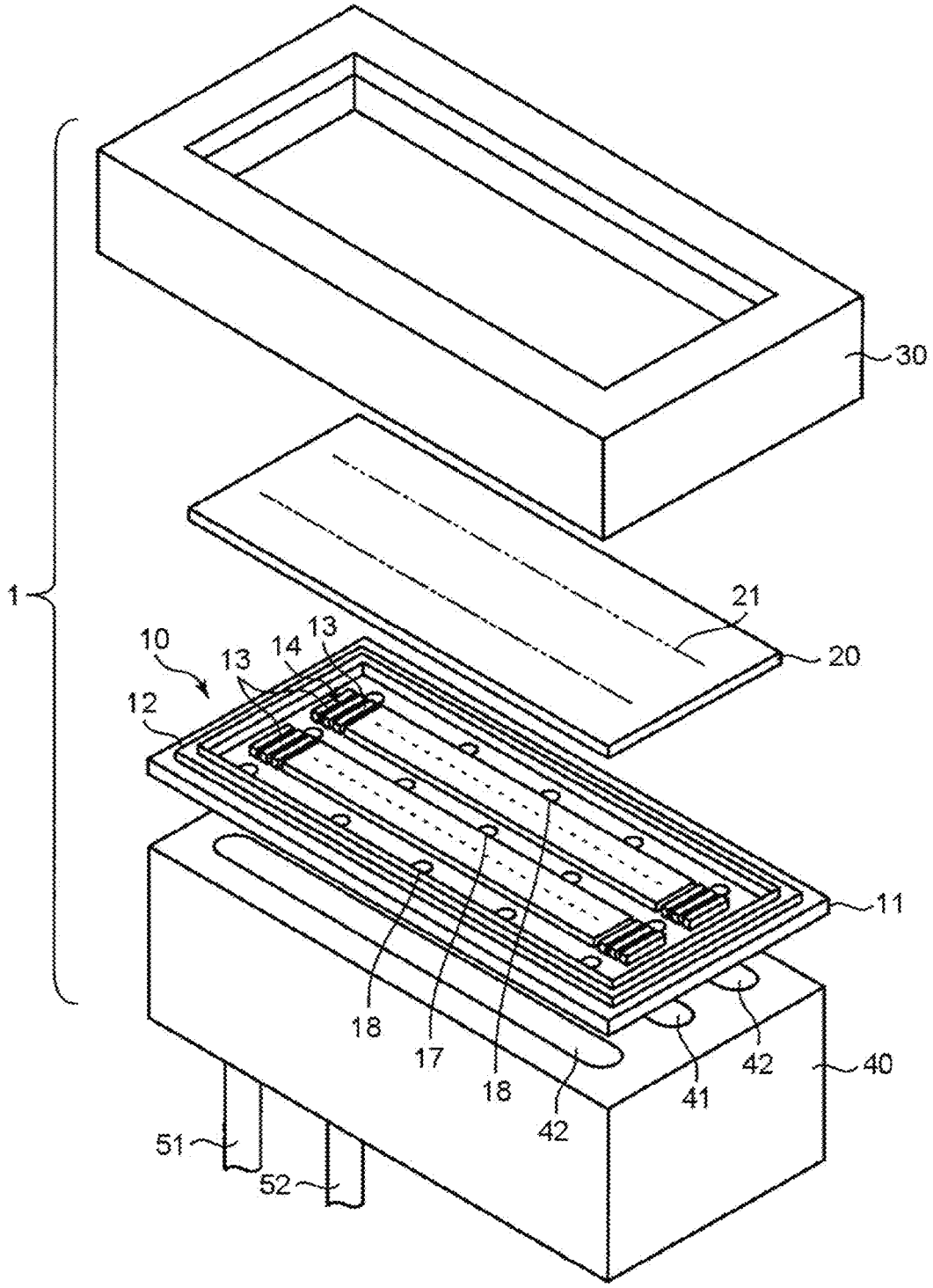
FIG. 1 is a perspective view schematically illustrating a dispersed inkjet head according to an embodiment.
Figure 2A:
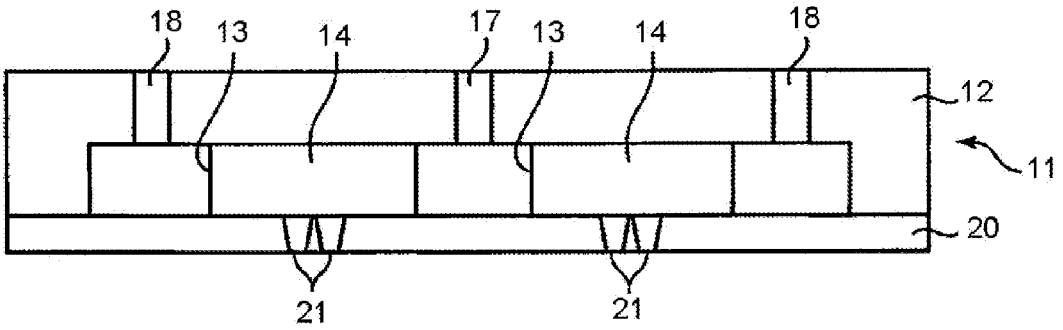
FIG. 2A is a schematic illustration diagram illustrating a head portion of the inkjet head according to the embodiment observed from a lateral side.
Figure 2B:
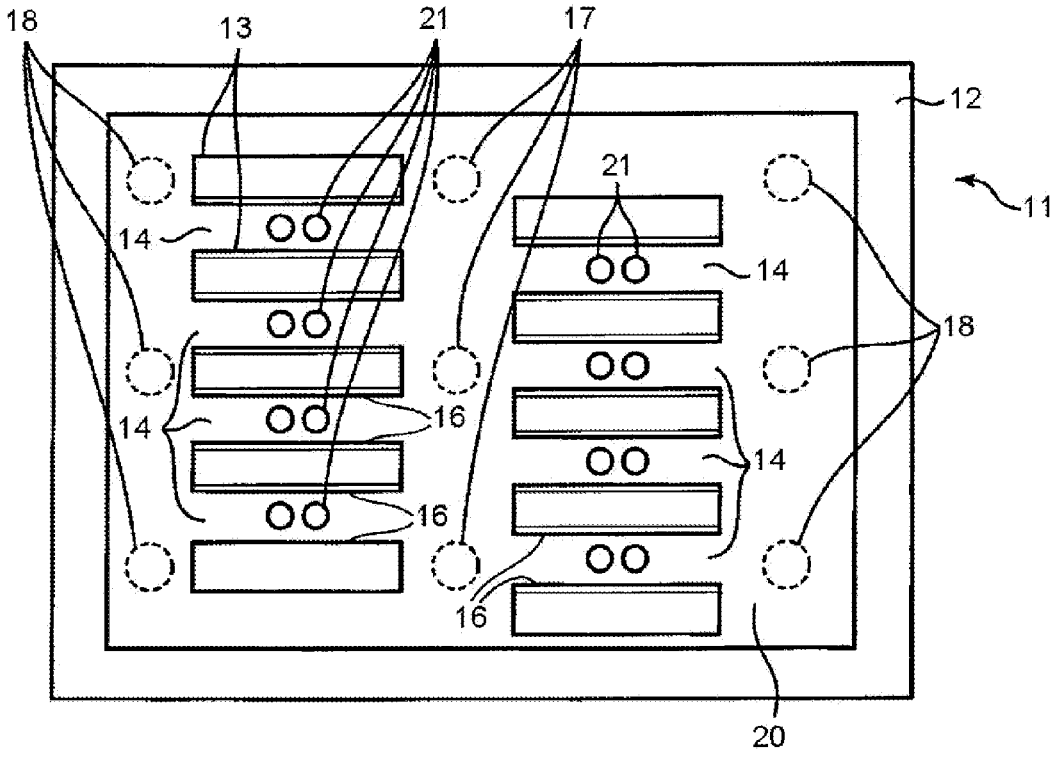
FIG. 2B is a schematic illustration diagram illustrating a head portion of the inkjet head according to the embodiment observed from a plane side.

Hereinafter, the present embodiment is described with reference to FIG. 1~FIG. 5. FIG. 1 illustrates an inkjet head 1 serving as a liquid ejection head according to the embodiment. The inkjet head 1 comprises a head portion 10, a mask plate 30 and a holder 40. The head portion 10 is provided with an ink pressure chamber structure body 11 and a nozzle plate 20 serving as the plate.

The ink pressure chamber structure body 11 is, for example, formed with ceramic such as alumina, or glass. A plurality of piezoelectric member partition walls 13 serving as driving sections (driver) is formed in the interior side surrounded by a frame 12 of the ink pressure chamber structure body 11. The plurality of piezoelectric member partition walls 13 is arranged in two rows in the interior side surrounded by a frame 12 of the ink pressure chamber structure body 11. The piezoelectric member partition wall 13 is made from a piezoelectric material having a high electrostriction constant such as the PZT (lead zirconate titanate (Pb (Zr, Ti)$O_3$) and the like.

The arrangement of the plurality of piezoelectric member partition walls 13 formed in the ink pressure chamber structure body 11 is not limited to two rows, and may be one row or more than three rows.

The nozzle plate 20 is, for example, formed by resin such as polyimide, or metal having heat-resistance such as a nickel alloy and stainless steel. In the nozzle plate 20, a plurality of nozzles 21 serving as liquid ejection sections which pierces the nozzle plate 20 in the depth direction thereof is formed. The nozzle plate 20 is bonded to the frame 12 and the piezoelectric member partition walls 13.

A space surrounded by the frame 12, the piezoelectric member partition wall 13 and the nozzle plate 20 constitutes an ink pressure chamber 14 serving as the pressure generation chamber. The nozzles 21 formed in the nozzle plate 20 are connected to the ink pressure chambers 14. In the head portion 10, two nozzles 21 (a nozzle 21*a* and a nozzle 21*b*) are arranged for each ink pressure chamber 14. By arranging two nozzles 21 for each ink pressure chamber 14, the inkjet head 1 ejects a desired amount of ink serving as the liquid to an image receiving medium efficiently. The ink is made of, for example, an organic solvent, an aqueous solution or the like The ink pressure chamber structure body 11 includes an ink supply port 17 and an ink discharge port 18. The ink supply port 17 supplies ink to the ink pressure chamber structure body 11 from an ink introducing path 41 of the holder 40. The ink discharge port 18 discharges the ink in the ink pressure chamber structure body 11 to an ink collection path 42 of the holder 40. The ink introducing path 41 is connected with an introducing pipe 51 for introducing ink from outside, and the ink collection path 42 is connected with a collection pipe 52 for collecting ink to the outside.

The head portion 10 supplies the ink flowing through the introducing pipe 51 and the ink introducing path 41 from the ink supply port 17 to the ink pressure chamber structure body 11 to fill the ink in the ink pressure chambers 14. The head portion 10 collects the ink in the ink pressure chamber structure body 11 flowing through the ink discharge port 18 and the ink collection path 42 in the collection pipe 52 to circulate the ink to be filled in the ink pressure chamber 14. In this way, the ink in the ink pressure chamber 14 is maintained at a constant temperature.

Electrodes 16 are arranged at the lateral sides of the piezoelectric member partition walls 13 inside the ink pressure chamber 14. When a voltage is applied to the electrodes 16, the piezoelectric member partition walls 13 are deformed and a pressure fluctuation occurs in each of the ink pressure chambers 14, and as a result, ink droplets are ejected from the two nozzles 21 of each ink pressure chamber 14. The mask plate 30 which is, for example, made of metal is boned to the frame 12 to mask around the nozzle plate 20.

Figure 3:
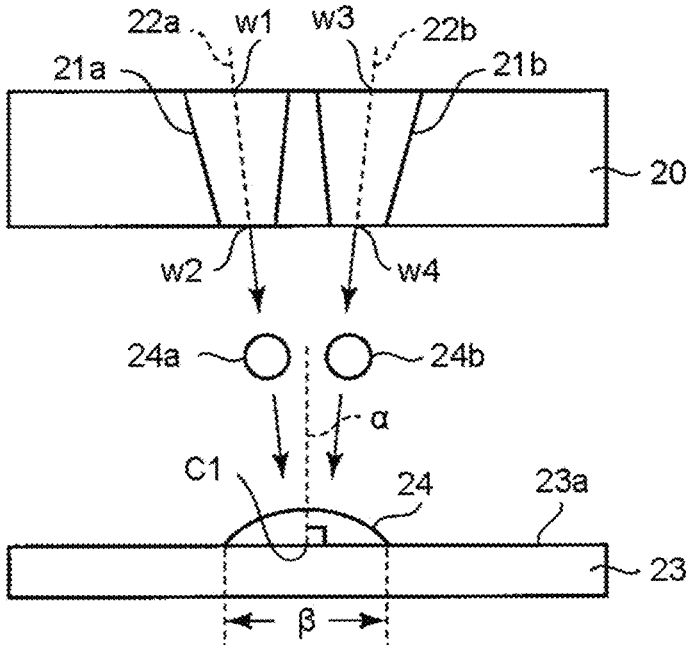
FIG. 3 is a schematic illustration diagram illustrating a direction of axis and a dot area of nozzles according to the embodiment.
Figure 4:
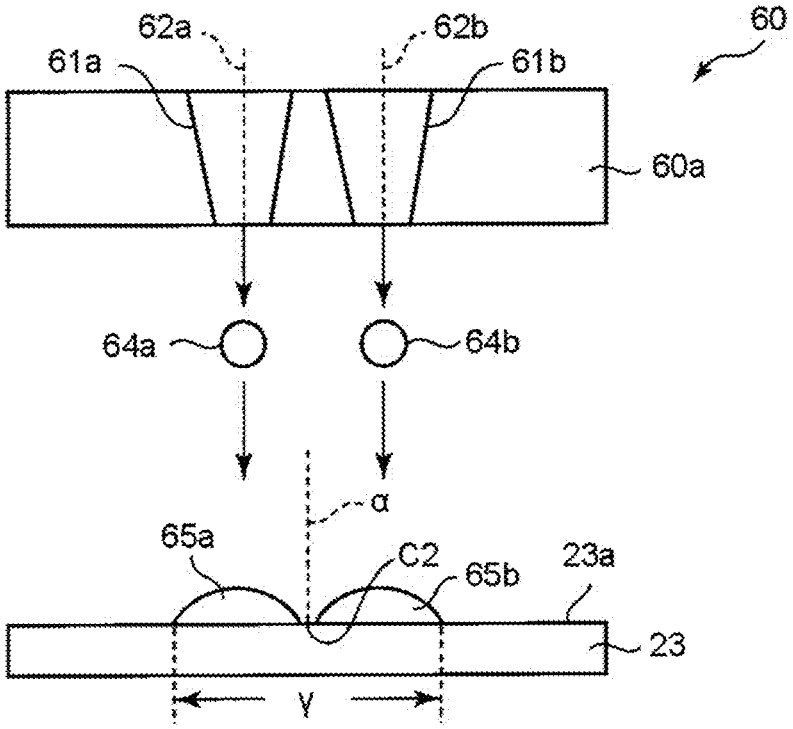
FIG. 4 is a schematic illustration diagram illustrating a direction of axis and a dot area of nozzles according to a comparative embodiment.

Two nozzles 21*a*, 21*b* piercing the nozzle plate 20 are formed in the same shape. As shown in FIG. 3, axes 22*a*, 22*b* of the two nozzles 21*a*, 21*b* are respectively directed to a direction of a center C1 of a dot area β serving as the ink impact area in an image receiving medium 23. The axis 22*a* of the nozzle 21*a* is a line connecting a center of gravity of area w1 at the inlet side of the nozzle 21*a* with a center of gravity of area w2 at the outlet side thereof. The axis 22*b* of the nozzle 21*b* is a line connecting a center of gravity of area w3 at the inlet side of the nozzle 21*b* with a center of gravity of area w4 at the outlet side thereof. The axes 22*a*, 22*b* are inclined against a α direction which is perpendicular to a surface 23*a* of the image receiving medium 23 in such a manner that the axes 22*a*, 22*b* are directed to the direction of the center C1 of the dot area β in the image receiving medium 23.

In the inkjet head 1 with such a constitution, when a voltage is applied to the electrodes 16, the piezoelectric member partition walls 13 are deformed, and thus pressure fluctuation occurs in the ink pressure chambers 14. Through the pressure fluctuation, an ink droplet 24*a* and an ink droplet 24*b* having almost same amount are respectively ejected from the nozzles 21*a*, 21*b*. The ink droplet 24*a* and the ink droplet 24*b* which are respectively ejected from the nozzles 21*a*, 21*b* are gathered towards the direction of the center C1 of the dot area β in the image receiving medium 23 due to the inclination of each of the axes 22*a*, 22*b* of the nozzles 21*a*, 21*b*. The ejected ink droplets 24*a*, 24*b* are coalesced at the time of impacting on the image receiving medium 23 to form an impact dot 24 in the dot area β. Because the ejected droplets 24*a*, 24*b* are coalesced in the image receiving medium 23 without dispersing, a desired high concentration printing or high-speed printing can be realized efficiently. The nozzles 21*a*, 21*b* of which the axes 22*a*, 22*b* are directed to the direction of the center C1 of the dot area β in the image receiving medium 23 prevent the dot area β in the image receiving medium 23 from expanding.

As a comparative example of the head portion 10 of the present embodiment, an ink impact area of a head portion of which two axes of nozzles aren't inclined is described. In a head portion 60 as shown in the comparative example in FIG. 4, each of axes 62*a*, 62*b* of two nozzles 61*a*, 61*b*, which are formed in a nozzle plate 60*a* for each ink pressure chamber, is parallel to the α direction perpendicular to the surface 23*a* of the image receiving medium 23.

An ink droplet 64*a* and an ink droplet 64*b* respectively ejected from the nozzles 61*a*, 61*b* of the head portion 60 in the comparative embodiment are dropped straight in the α direction perpendicular to the surface 23*a* of the image receiving medium 23. The ink droplet 64*a* and the ink droplet 64*b* that are dropped straight in the α direction perpendicular to the surface 23*a* of the image receiving medium 23 are impacted on the image receiving medium 23 respectively instead of coalesced, and form an impact dot 65*a* and an impact dot 65*b*. In the comparative embodiment, the ink droplet 64*a* and the ink droplet 64*b* respectively ejected from the nozzles 61*a*, 61*b* are dispersed into two impact dots 65*a*, 65*b* in the image receiving medium 23, and as a result, the dot area is also expanded to an area γ. In the comparative embodiment, the dot area is expanded since the impact dots 65*a*, 65*b* are dispersed, which hinders an efficient high concentration printing or high-speed printing.

In accordance with the present embodiment, each of axes 22*a*, 22*b* of the two nozzles 21*a*, 21*b* for each ink pressure chamber 14 are directed to the direction of the center C1 of the dot area β in the image receiving medium 23. The ink droplets 24*a*, 24*b* with desired amount respectively ejected from the nozzles 21*a*, 21*b* are directed to the direction of the center C1 of the dot area β in the image receiving medium 23 to gather and coalesce in the image receiving medium 23. Since the ink 24 with desired amount can be coalesced in the dot area β, it is possible to perform a high concentration printing or high-speed printing efficiently.

The present invention is not limited to the embodiment stated above, and various modifications are possible. No limitation is given to the number or the arrangement and the like of the liquid ejection section for each pressure generation chamber. A plurality of liquid ejection sections arranged for each pressure generation chamber may be arranged two-dimensionally.

Figure 5:
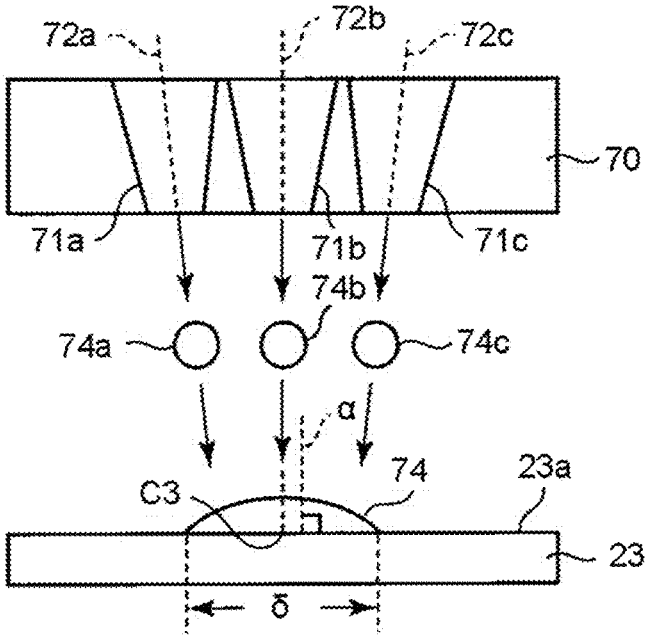
FIG. 5 is a schematic illustration diagram illustrating a direction of axis and a dot area of nozzles according to a modification of the embodiment.

For example, as shown in the modification in FIG. 5, three nozzles 71*a*, 71*b*, 71*c* piercing a nozzle plate 70 may be arranged for each ink pressure chamber to obtain a high concentration printing or high-speed printing. In the modification, each of axes 72*a*, 72*b* and 72*c* of three nozzles 71*a*, 71*b*, 71*c* are directed to a direction of a center C3 of an ink dot area δ in the image receiving medium 23. The axes 72*a*, 72*c* are inclined against the α direction which is perpendicular to the surface 23*a* of the image receiving medium 23 in such a manner that the axes 72*a*, 72*c* are directed to the direction of the center C3 of the dot area δ in the image receiving medium 23. The axis 72*b* is parallel to the α direction. Ink droplets 74*a*, 74*b* and 74*c* to be respectively ejected from the nozzles 71*a*, 71*b* and 71*c* are directed to the direction of the center C3 of the dot area δ in the image receiving medium 23. The ejected ink droplets 74*a*, 74*b* and 74*c* are coalesced in the image receiving medium 23 to form an impact dot 74 in the dot area δ. Because the ejected ink droplets 74*a*, 74*b* and 74*c* are coalesced instead of dispersed in the image receiving medium 23, a desired high concentration printing or high-speed printing can be efficiently realized.

Further, as long as the directions of axes of a plurality of liquid ejection sections are directed to the center direction of the impact area, the inclination angle of the axes against the center direction is not limited; and the ink droplets (liquid) ejected respectively may not be coalesced in the impact area as long as they are capable of approaching each other. Further, the constitution of the driving section is also not limited, and for example, a piezoelectric element may be arranged as the driving section in the plate in which the liquid ejection sections are formed. Furthermore, the category of the liquid and the category of the image receiving medium and the like are not limited. The liquid is not limited to ink, and may be liquid including conductive particles for forming a wiring pattern and the like. The image receiving medium may be a normal paper, a plastic film, a ceramic and the like.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid ejection head, comprising:

a pressure generation chamber in which liquid is filled;

a plate configured to connect with the pressure generation chamber and including a plurality nozzles as liquid ejection sections each with an axis directed to a center direction of an impact area of the liquid; and a driver configured to enable a pressure in the pressure generation chamber to fluctuate.

2. The liquid ejection head according to claim 1, wherein the axis of each of the plurality of nozzles is directed to a center direction of an impact area of the liquid and intersects with each other.

3. The liquid ejection head according to claim 2, wherein the axis of each of the plurality nozzles is a line connecting a center of gravity of area at an inlet side of each of the plurality of liquid ejection sections with a center of gravity of area at a corresponding outlet side of each of the plurality of liquid ejection sections.

4. The liquid ejection head according to claim 1, wherein the axis of each of the plurality of nozzles is a line connecting a center of gravity of area at an inlet side of each of the plurality of liquid ejection sections with a center of gravity of area at a corresponding outlet side of each of the plurality of liquid ejection sections.

5. The liquid ejection head according to claim 1, wherein the axis of each of the plurality of nozzles is directed to a direction in which the liquid respectively to be ejected from the plurality of nozzles is impacted on the impact area while approaching each other.

6. The liquid ejection head according to claim 1, wherein the axis of each of the plurality of nozzles is directed to a direction in which the liquid respectively to be ejected from the plurality of nozzles is coalesced and impacted on the impact area.

7. The liquid ejection head according to claim 1, wherein an interval between each of the plurality of nozzles is shorter than a diameter of each nozzle.

8. The liquid ejection head according to claim 1, wherein a depth of a nozzle plate is thicker than a diameter of each nozzle.

* * * * *